United States Patent [19]

Shiba et al.

[11] Patent Number: 4,500,618

[45] Date of Patent: Feb. 19, 1985

[54] ELECTROPHOTOGRAPHIC PROCESS FOR PRODUCING PRINTING PLATE AND PLATE MAKING MACHINE

[75] Inventors: Keisuke Shiba, Shizuoka; Hiromi Yazawa, Kanagawa; Chikashi Ohishi; Sho Nakao, both of Shizuoka, all of Japan

[73] Assignee: Fuji Photo Film Co., Ltd., Kanagawa, Japan

[21] Appl. No.: 508,754

[22] Filed: Jun. 28, 1983

[30] Foreign Application Priority Data

Jun. 30, 1982 [JP] Japan ..... 57-112759

[51] Int. Cl.[3] ..... G03G 13/26

[52] U.S. Cl. ..... 430/49; 430/117; 430/97; 430/124; 118/642

[58] Field of Search ..... 430/117, 118, 119, 49, 430/97, 124; 118/642, 643

[56] References Cited

U.S. PATENT DOCUMENTS 3,053,688 9/1962 Greig ..... 430/114 X 3,130,079 4/1964 Meister ..... 118/642 X 3,507,794 4/1970 Fauser et al. ..... 430/114 X 3,885,960 5/1975 Anderson ..... 430/118

*Primary Examiner*—John D. Welsh

*Attorney, Agent, or Firm*—Sughrue, Mion, Zinn, Macpeak & Seas

[57] ABSTRACT

A process for producing a printing plate and a printing plate making machine are disclosed. The process involves providing an electrophotographic plate making material which includes a base having a low conductive layer thereon. The material is electrically charged and imagewise exposed. The imagewise exposed material is subjected to liquid toner development with a toner containing a solvent. The solvent is then substantially removed by heating the material to a temperature sufficient to cause the evaporation of the solvent. The material is then moved to a substantially isolated fixing area and again heated in order to fix a toner image on the plate making material. The process can be quickly and easily carried out and eliminates the danger of the explosion of solvent vapors.

8 Claims, 3 Drawing Figures

ELECTROPHOTOGRAPHIC PROCESS FOR PRODUCING PRINTING PLATE AND PLATE MAKING MACHINE

FIELD OF THE INVENTION

The present invention relates to a process for producing a printing plate and a plate making machine capable of safely and stably obtaining a printing plate in a good reproduced state having excellent toner reproducibility of line images and long press life by electrophotography and, in greater detail, by electrophotography using liquid toner development. Particularly, the present invention relates to a plate making process and a plate making machine capable of safely and stably obtaining a printing plate in a good reproduced state having excellent properties, (even if used for a long time) from an electrophotographic plate making material described in, for example, U.S. patent application Ser. Nos. 405,773 (filed Aug. 6, 1982) now U.S. Pat. No. 4,456,670 and 427,037 (filed Sept. 29, 1982).

BACKGROUND OF THE INENTION

A known plate making process for electrophotographic plate making materials, comprises uniformly electrically charging the electrophotographic plate making material by corona discharge, imagewise exposing it to light, forming a toner image by liquid toner development, fixing the toner image by heating, and changing the nonimage part so as to have a hydrophilic property by processing with a desensitizing solution (etching solution) to obtain a printing plate.

Hitherto, such a plate making process has been carried out using a plate making machine, for example, shown in FIG. 1. Namely, in the prior plate making machine 1, as shown in FIG. 1, an electrophotographic plate making material 13 held in a preset part 2 in the form of a roll or sheet is guided by sending rolls 14 and 15 into an electric charge part 3 and uniformly electrically charged by corona discharge. It is then guided by a press roll 21 and a sending belt 20 into an exposure part 4 and imagewise exposed to an original 8 through a projection optical system 9 comprising a light source 11 and a reflection mirror 10. The imagewise exposed plate making material is then sent to a liquid toner development part 5 by rolls 16 and developed with a toner supplied from a liquid toner tank 12. It is then sent to a fixation part 6 by rollers 17 and 18. After being fixed by heating, it is collected as a printing plate in a collection part 7 by rolls 19.

In the plate making process, a step for fixing by heating after liquid toner development is particularly important for obtaining excellent properties, which is different from the image recording process by electrophotography. Namely, in order to obtain a printing plate having excellent images and sufficient printing durability, it is necessary to carry out fixation at a suitable temperature for a suitable time so as to fit properties of the toner. If the fixation is carried out rapidly at a too high temperature, the line image becomes blurred or resolving power deteriorates. If the fixation is carried out unevenly at a too low temperature, the press life remarkably reduces.

In a liquid toner developer, generally, a polymer or resin having electric charges is dispersed as fine particles having a size of about $0.01\mu$ to $10\mu$ in an electrically insulating liquid such as liquid hydrocarbons or halogenated hydrocarbons, for example, a petroleum solvent.

Another problem in the step for fixing by heating is that the heating is carried out in the presence of an inflammable gas of the petroleum solvent carried therein.

The function of the fixation part of the conventional plate making machine is to complete the drying of the toner solvent adhered to the plate making material by evaporation and thermal fusion of components of toner particles within a short time of, generally, several seconds or less. It is effective to use a method of blowing hot air against the surface of the passing plate making material by means of an electric heater and a fan. However, if plate making is continuously carried out for a long time, evaporation of the solvent continues to increase a gas concentration of the solvent in the atmosphere, and there is thus the possibility of ignition or explosion due to a heater. In order to prevent such a danger, it is possible to use a plate heater. In this process, a panel heater controlled so as to have a fixed temperature in a range from about 80° to 150° C. is placed in the fixation part and the fixation is carried out by bringing the back of the plate making material into contact with the panel heater. According to this process, the danger of ignition or explosion diminishes even if the gas concentration of the solvent increases. However, this process is not desirable because the fixation requires too much time because fixing ability is inferior as compared with the above described process which comprises drying with hot air by heating.

As an electrophotographic plate making material capable of use for the present invention, there is, for example, an electrophotographic plate making material which has a base having a laminated layer composed of polyolefin or metal foil on at least one side of the paper stock and having a volume resistance of $10^{10}\Omega$ or less and a photoconductive layer provided on said base. The volume resistance is obtained by reading a value of electric current (A) upon an application of direct current voltage (V) when a sample is interposed by two disc electrodes made of metal having 2.5 cm of raius.

Volume resistance $R_V = V/A(\Omega)$ However, when this material is rapidly heated to 80° to 100° C. or more by bringing it into direct contact with the fixation part, the laminated layer becomes soft or the surface friction resistance becomes high to make it difficult to pass the laminated material through the fixation part, i.e., to deteriorate passing behaivor.

SUMMARY OF THE INVENTION

An object of the present invention is to improve the above described faults. As a result of various studies, the present inventors have found that the above described object can be attained by the following invention.

Namely, the present invention relates to a process for producing a printing plate which comprises carrying out electric charge, image exposure, liquid toner development and fixation of an electrophotographic plate making material having a photoconductive layer on a base, which is characterized by substantially removing a solvent for toner development by heating to evaporate after carrying out liquid toner development and, thereafter, fixing a toner image formed on the plate making material in a fixation part isolated from the other parts by heating the surface of the plate making material to a temperature higher than the temperature for evaporating the solvent. The present invention also relates to a printing plate making machine.

Figure 1:
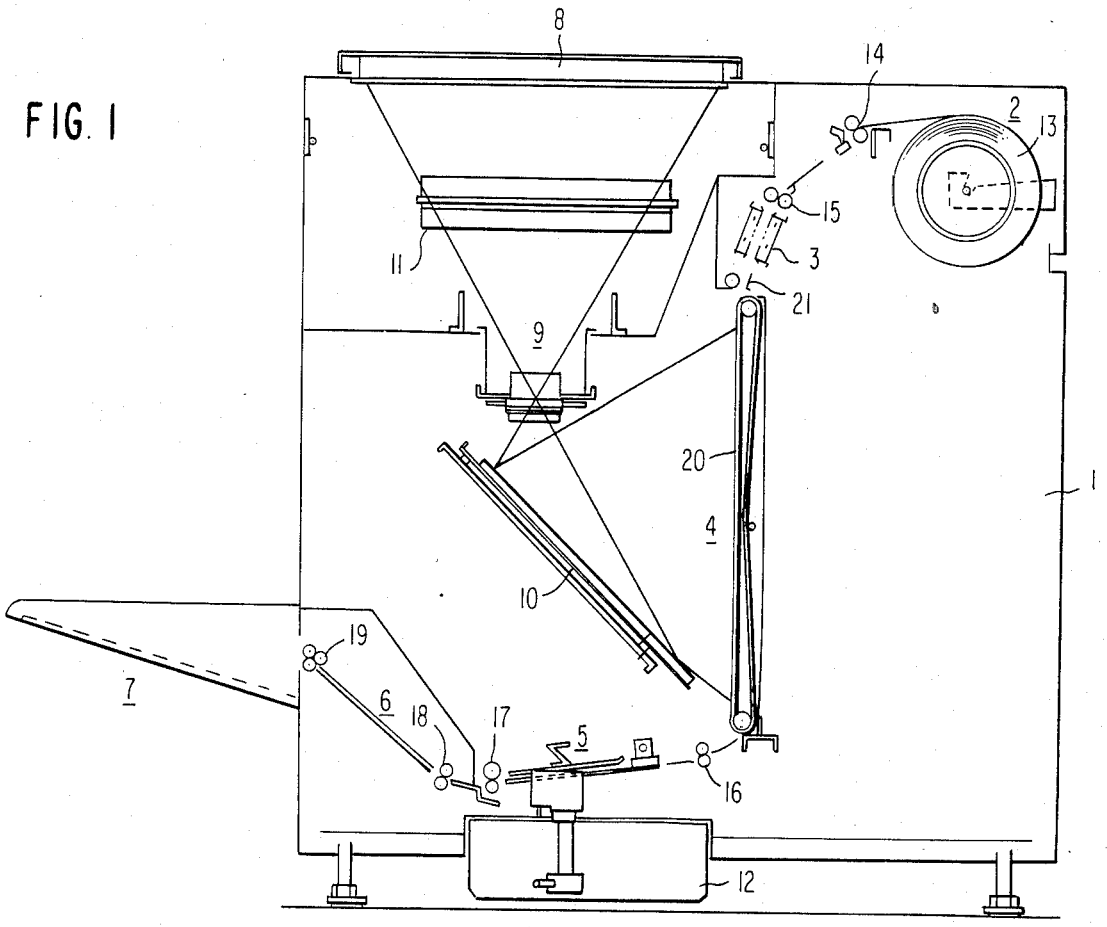
FIG. 1 is a schematic plan view which indicates an example of the prior electrophotographic plate making machine.

In the drawings, 3 is an electric charge part, 4 is an image exposure part, 5 is a liquid toner development part, 6 is a fixation part, 7 is a collection part, 6' and 31 are each a drying part, and 32 and 41 are each a fixation part.

DETAILED DESCRIPTION OF THE INVENTION

The present invention is described below in detail with reference to the drawings.

The plate making process of the present invention is particularly effective when the electrophotographic plate making material is a plate making material which has a base having a laminated layer composed of polyolefin or metal foil on at least one side of the paper stock and having a volume resistance of $10^{10}\Omega$ or less.

Suitable thin metal foils are aluminum, copper, gold, silver, etc. and suitable polyolefins which can be laminated on the paper support are polyethylenes, polypropylenes, polybutylenes, polypentenes, etc., with polyethylenes and polypropylenes being preferred. Particularly preferred polyethylenes are those having a density of about 0.92 to 0.96 g/cm$^3$, an average molecular weight of about 20,000 to 50,000, a softening point of about 110° to 130° C., a tensile strength of 130 to 300 kg/cm$^2$ and a specific volume resistance of about $10^{15}\Omega$.cm or more, and particularly preferred polypropylenes are those having a density of about 0.85 to 0.92 g/cm$^3$, a softening point of about 75° to 170° C., a tensile strength of about 280 to 420 kg/cm$^2$ and a specific volume resistance of about $10^{15}\Omega$.cm or more. Polyethylene is most preferred as a polyolefin.

An electroconductive material may be present in the polyolefin laminate layer in an amount such that the substrate ultimately obtained has a volume resistance of about $10^{10}\Omega$ or less. This minimizes the change of the photographic characteristics of the resulting printing plate due to changes in humidity (particularly, at lower humidity) and provides the ability to produce a lithographic printing plate having a good image quality and excellent printing durability. Particularly preferred electroconductive materials are metal oxides described, for example, in French Pat. No. 2,277,136 and U.S. Pat. No. 3,597,272, such as fine particules of oxides of metals selected from zinc, magnesium, tin, barium, indium, molybdenum, aluminum, titanium and silicon, preferably crystalline oxides or composite oxides thereof; or carbon black. Exemplary metal oxides include electroconductive zinc oxide, electroconductive tin oxide and electro-conductive titanium oxide. Of these, electroconductive carbon black is inexpensive and highly miscible with polyolefins and can be advantageously used.

These electroconductive materials are used in an amount such that the volume resistance of the substrate ultimately obtained is about $10^{10}\Omega$ or less, preferably $10^{8}\Omega$ or less, and most preferably $10^{6}\Omega$ or less. The amount of the electroconductive materials to achieve the above resistance value varies depending upon the type of the paper support, polyolefin and the electroconductive materials used but the electroconductive materials can generally be used in an amount of about 5 to 30 wt% based on the weight of the polyolefins.

These polyolefins are laminated onto at least one, preferably both surfaces of a paper support.

A suitable thickness of the polyolefin layer is in the range of from about 5 to 50$\mu$. If it is thinner than about 5$\mu$, the paper support is not sufficiently waterproof and on the other hand, if it is thicker than about 50$\mu$, no further improvement in the effect is achieved, resulting in merely increasing the cost. The preferred thickness is from 10 to 30$\mu$.

To increase the adhesive strength between the paper support and the polyolefin laminate layer, it is preferred for the paper support to be previously coated with polyethylene derivatives or the surface of the paper support to be previously subjected to corona discharge treatment.

The paper support used in the present invention can be any of the conductive paper supports which have heretofore been used in electrophotographic sensitive materials, such as those prepared by impregnating ion transfer materials or electroconductive materials such as inorganic metal compounds or carbon black as described in U.S. Pat. No. 3,597,272 and French Pat. No. 2,277,136 into a paper or blending those into a paper during paper making; synthetic papers as described in Japanese Patent Publications No. 4239/77, 19031/78 and 19684/78. Suitable paper supports which can be used include, for example, chemical pulps, kraft pulps, mixtures of chemical pulps and kraft pulps, synthetic resin papers, etc.

Figure 2:
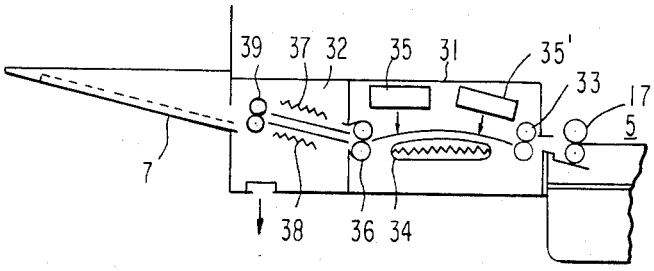
FIG. 2 is a schematic plan view showing the drying part and the fixation part in the plate making machine used in the present invention.

FIG. 2 is a schematic plan view showing an embodiment of the drying part and the fixation part in the plate making machine used in the present invention. In FIG. 2 the fixation part 6 in the prior plate making machine shown in FIG. 1 is improved so as to be used for the present invention. More specifically, the plate making machines used in the present invention are prepared by replacing the fixation part 6 shown in FIG. 1 by the drying part 31 and the fixation part 32 shown in FIG. 2. As described above, the plate making material on which a toner image is formed by development in the liquid toner development part 5 is sent to the drying part by squeeze sending rolls 17 and sending rolls 33 provided in the drying part 31, and the plate making material is dried by heating the back of the plate making material by means of a panel heater 34 in the drying part to substantially remove the solvent by blowing air by means of fans 35 and 35'. It is then sent to the fixation part 32 by sending rolls 36 and fixed within a sufficiently short time by heating directly by means of heaters 37 and 38. The fixation part 32 is isolated from the other parts by a wall or an air curtain and sending rolls 36 and 39. The fixed printing plate is collected in the collection part 7 by the sending rolls 39. Generally, it passes through the drying part at 18° C. to 50° C. within, preferably, 60 seconds or less and the fixation part at about 50° to 150° C., preferably 50° to 120° C. within 5 to 30 seconds, preferably, 10 to 20 seconds. Useful heating means include electric heaters, infrared ray application and panel heaters. However, in the drying part, it is necessary to select a heating means which does not bring the solvent into direct contact with the heat source and is capable of easily controlling the temperature of the part which does contact the solvent to a temperature at or below the ignition point of the solvent. Heating temperature and time are decided mainly based on a toner and a solvent for toner development. The solvent for toner development includes benzene, cyclohexane, freon, kelosene, gasoline, petroleum solvent, etc.

Figure 3:
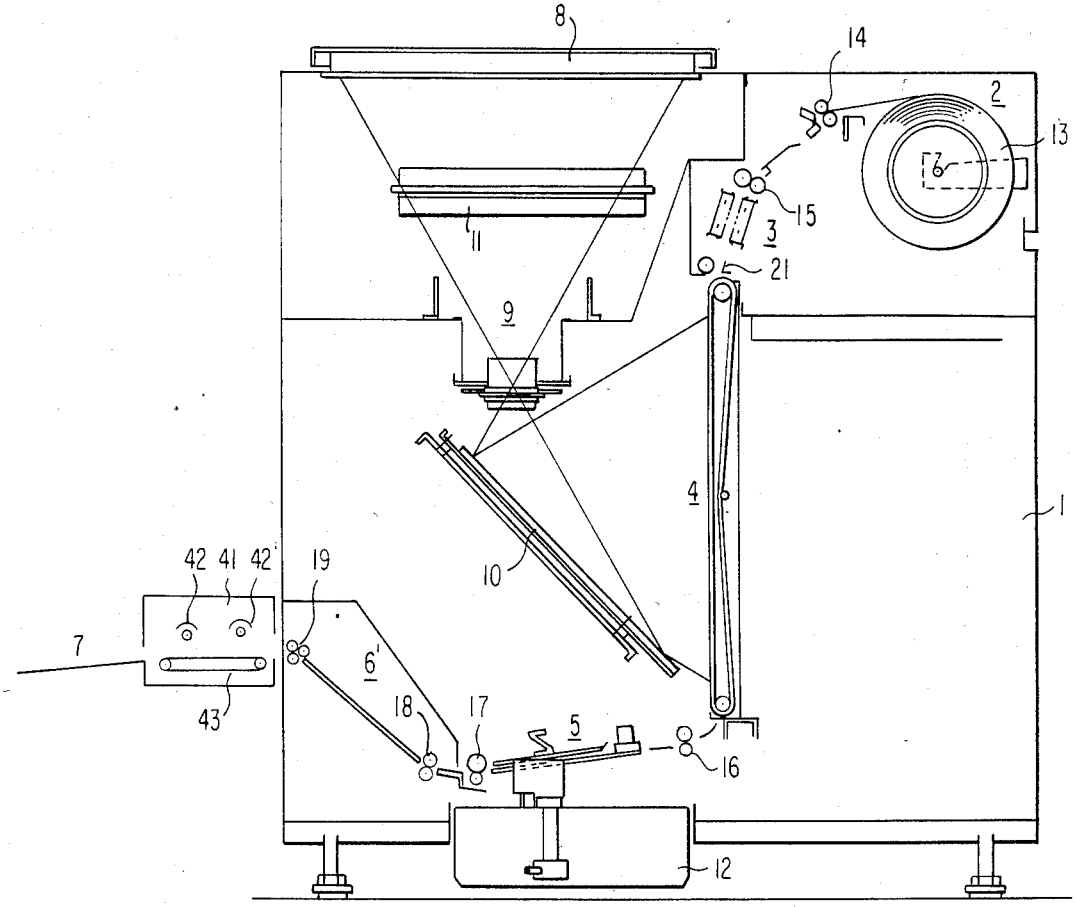
FIG. 3 is a schematic plan view showing another example of the plate making machine used in the present invention.

FIG. 3 is a schematic plan view showing another embodiment of the plate making machine used in the present invention, wherein the fixation part 6 shown in FIG. 1 is used as a drying part 6' having a controlled temperature. Further, a fixation part 41 is additionally provided. A complete explanation of the other symbols in FIG. 3 is omitted, because they represent the same meanings as in FIG. 1. The fixation part 41 is provided with infrared ray lamps 42 and 42' which act as a heater and a belt 43 laid on sending rolls. The fixation part 41 is isolated from the other parts by walls, etc. The plate making material from which the solvent is removed by evaporation in the drying part 6' is sent to the fixation part 41 by sending rolls 19 and a belt 43. After being fixed by heating by means of heaters 42 and 43, the electrophotographic plate is collected in the collection part 7.

In the following, an example of the plate making process is shown. Although the present invention is not limited to it, details of the invention will be understood thereby.

EXAMPLE

An electrophotographic plate making material was produced according to Example 1 of U.S. patent application Ser. No. 427,037 filed Sept. 29, 1982. After being allowed to stand in the dark at 25° C. and 45% RH for 12 hours, plate making was carried out using a plate making machine wherein the fixation part 6 shown in FIG. 1 was improved by being divided into a drying part and a fixation part shown in FIG. 2. The toner used was a liquid toner produced by Itek Co. (using petroleum solvent: Isoper G (trade name by Esso Co.) as a solvent). The etching solution used was produced by Addressomultigraph Co. After the material was electrically sent from a preset part and charged, it was imagewise exposed. After carrying out toner development, it was dried in the drying part at 30° to 40° C. for 15 seconds and fixed in the fixation part at 100° C. for 15 seconds. Desensitization was carried out with the etching solution to obtain a printing plate. The plate was set on an offset printer: Hamadastar 700. When printing was carried out, 20,000 or more of prints were obtained. The resulting prints had excellent images, wherein halftone dots images of 133 lines/inch were reproduced.

While the invention has been described in detail and with reference to specific embodiment thereof, it will be apparent to one skilled in the art that various changes and modifications can be made therein without departing from the spirit and scope thereof.

What is claimed is:

1. A process for producing a printing plate, comprising the steps of:

providing an electrophotographic plate making material comprised of a base having a photoconductive layer thereon;

electrically charging the plate making material;

imagewise exposing the material;

subjecting the material to liquid toner development in a toner containing a solvent;

substantially removing the solvent by heating to a temperature sufficient to cause evaporation of the solvent;

moving the material to a fixation area; and fixing a toner image on the plate making material by heating the material to a temperature higher than the temperature sufficient to cause evaporation of the solvent.

2. A process for producing a printing plate as claimed in claim 1, wherein the electrophotographic plate making material is comprised of a paper stock base having laminated thereon a materials selected from the group consisting of polyolefin and metal foil, the plate making material having a volume resistance of $10^{10}\mu$ or less.

3. A process for producing a printing plate as claimed in claim 1, wherein the fixing is carried out by heating the plate making material in the fixation area to a temperature of 50° C. or more.

4. A process for producing a printing plate as claimed in claim 2, wherein the fixing is carried out by heating the plate making material in the fixing area to a temperature of 50° C. or more.

5. A process for producing a printing plate as claimed in claim 1, wherein the removing of solvent is carried out at a temperature within the range of 18° C. to 50° C. over a period of time of 60 seconds or less.

6. A process for producing a printing plate as claimed in claim 1, wherein the fixing is carried out at a temperature within the range of 50° C. to 150° C. over a period of time of 5 to 30 seconds or less.

7. A plate making machine comprising a means for providing electric charge on an electrophotographic plate making material having a photoconductive layer on a base, a means for image exposure, a means for liquid toner development and a means for fixation, which is characterized by that the means for fixation comprises a drying part and a fixation part which is isolated from other parts by a wall and sending rolls.

8. A process for producing a printing plate as claimed in claim 1 wherein said toner containing a solvent comprises a polymer or resin having electric charges dispersed as fine particles having a size of about $0.01\mu$ to $10\mu$ in a electrically insulating liquid selected from the group consisting of liquid hydrocarbons and halogenated hydrocarbons.

* * * * *